US006758772B1

(12) United States Patent
Chambers et al.

(10) Patent No.: US 6,758,772 B1
(45) Date of Patent: Jul. 6, 2004

(54) DARTS

(76) Inventors: Robert Paul Chambers, 13806 Flairwood, San Antonio, TX (US) 78233; Tim F. Dodgen, 13806 Flairwood, San Antonio, TX (US) 78233

( * ) Notice: Subject to any disclaimer, the term of this patent is extended or adjusted under 35 U.S.C. 154(b) by 0 days.

(21) Appl. No.: 10/446,505

(22) Filed: May 29, 2003

(51) Int. Cl.[7] ..... A63B 65/02
(52) U.S. Cl. ..... 473/578
(58) Field of Search ..... 473/578, 582, 473/585, 586; D21/387

(56) References Cited

U.S. PATENT DOCUMENTS 4,021,041 A * 5/1977 Goldfarb et al.
4,114,884 A * 9/1978 Tunnicliffe
4,457,514 A 7/1984 Paxman
5,324,044 A * 6/1994 Giegerich
5,375,850 A 12/1994 Pickett
D380,784 S 7/1997 Smith
D381,372 S 7/1997 Smith
D393,665 S 4/1998 Smith
D395,465 S 6/1998 Smith
D399,539 S 10/1998 Smith et al.
6,585,612 B1 * 7/2003 Weissmann

* cited by examiner

*Primary Examiner*—John A. Ricci

(57) ABSTRACT

A dart that resembles various U.S. military missiles such as Patriot and Bunker Buster missiles, for example. The dart includes a hollow elongate barrel section having a longitudinal axis and including generally conical opposed end portions integral therewith. The end portions thereof define threaded female end portions respectively. The dart further includes a plurality of elongate shaft sections each having a threaded male end portion removably connectable to the threaded female end portions respectively so that the barrel section becomes disposed between the plurality of shaft sections. The plurality of shaft sections each further have a plurality of slits formed therein. The dart further includes a plurality of fin sections removably engageable with the plurality of slits respectively and for assisting the dart to maintain a predetermined flight trajectory. The dart may be painted with a variety of designs such as the American flag and camouflage, for example.

19 Claims, 3 Drawing Sheets

DARTS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

TECHNICAL FIELD

This invention relates to darts and, more particularly, to darts that resemble various types of missiles used by the United States military.

PRIOR ART

Many improvements have been made over the years for darts which are adapted to be thrown through the air from a first location to a target location, such as a dart board hung on a vertical wall. For the most part, these improvements have been generally satisfactory to provide more efficient arrangement of dart parts and to enhance the skills and accuracy of the users of the darts.

Improvements in darts typically center on the distribution of weight as the dart itself remains in a substantially streamlined form. Thus, the dart will encounter less air turbulence or other manifestations of the air which would otherwise adversely affect the trajectory of the dart as it is thrown through the air. The aim, of course, is to have trouble-free movement of the darts so that, as the skills of the user improve, the chances of anticipating greater scoring success increase. Moreover, the interest in the game of darts itself will be enhanced since knowledge of the improvements of the darts will stimulate the user to want to enter and play the game of darts with all comers.

While substantial improvements have been made over the years, there is still room for additional improvements to thereby enhance the skills of the users of the darts and to generate continued interest in the game of darts notwithstanding very long play periods which are characteristic of the game of darts. The present invention satisfies the need for additional improvements as will hereinafter be described.

BRIEF SUMMARY OF THE INVENTION

In view of the foregoing background, it is therefore an object of the present invention to provide darts that resemble various U.S. missiles and to thereby invoke a patriotic spirit and sense of pride through their use. These and other objects, features, and advantages of the invention are provided by a dart including a hollow elongate barrel section having a longitudinal axis and including generally conical opposed end portions integral therewith. The end portions thereof define threaded female end portions respectively.

The dart further includes a plurality of elongate shaft sections each having a threaded male end portion removably connectable to the threaded female end portions respectively so that the barrel section becomes disposed between the plurality of shaft sections. One of the plurality of shaft sections further has an opposed threaded female end portion. The plurality of shaft sections each further have a plurality of slits formed therein.

The dart further includes a plurality of fin sections removably engageable with the plurality of slits respectively and for assisting the dart to maintain a predetermined flight trajectory. The plurality of fins are preferably disposed outwardly from the longitudinal axis of the barrel section. A tip section preferably has a male end portion removably connectable to the threaded female end portion of the one shaft section.

The elongate barrel section may have an outer surface having a plurality of substantially equally spaced grooves formed therein and between the end portions thereof. The plurality of slits formed in one of the shaft sections preferably extends from the threaded male end portion thereof to generally midway a length thereof. Another one of the plurality of shaft sections may have a non-threaded end portion with its plurality of slits extending therefrom to generally midway a length thereof.

One of the plurality of fin sections may have four sides integral with each other. Alternately, another one of the plurality of fin sections may have five sides integral with each other. The plurality of slits may also be substantially equally spaced apart about a perimeter of said plurality of shaft sections respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
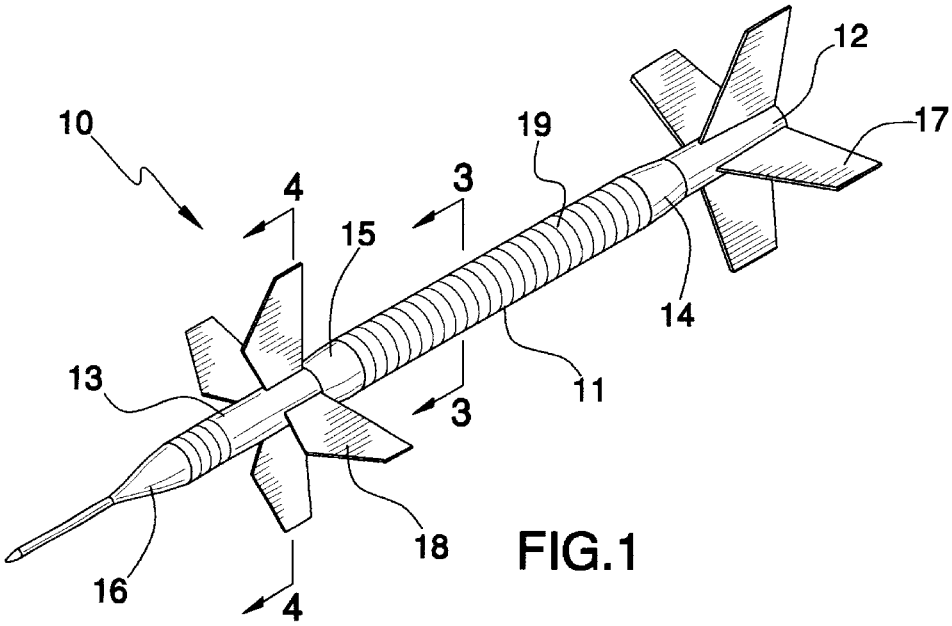
FIG. 1 is a perspective view showing a dart resembling a missile, in accordance with the present invention.

The dart of this invention is referred to generally in FIG. 1 by reference numeral 10 and is intended to resemble a U.S. military missile such as Bunker Buster, for example. It should be understood that the dart 10 may be modified to resemble other U.S. military missiles such as Patriots, Sidewinders and Cluster Bombs, for example, and should not be limited to resembling only Bunker Buster missiles.

The dart 10 includes an elongate barrel 11 section defining mid-region thereof. The barrel section 11 has oppositely disposed end portions 14, 15 that are generally conical or convex. Such end portions have an interior surface that is threaded for receiving shaft sections 12, 13, respectively. The barrel section 11 includes a plurality of substantially equally spaced grooves 19, which are formed substantially transverse to a longitudinal axis thereof. Shaft section 12 defines a rear portion of dart 10 and has a rear fin 17 connected thereto. Shaft section 13 is oppositely spaced from shaft section 12 and defines a front portion of dart 10. Front fin 18 is connected to shaft section 13 at one end portion thereof and a tip section 16 threadably engages shaft section 13 at an opposed end portion thereof.

Figure 2:
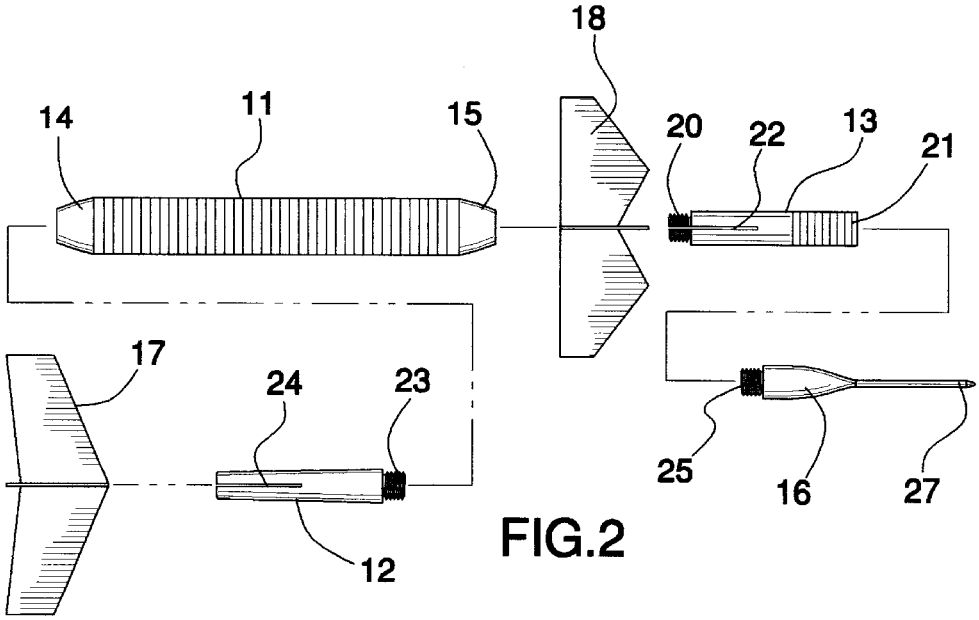
FIG. 2 is an exploded view of FIG. 1.

Now referring to FIG. 2, rear fin 17 has four sides integral with each other and positioned in substantially four different quadrants. Shaft section 12 is shown as having a rear portion with a diameter slightly smaller than a front portion thereof. A threaded male end portion 23 is connected to the front portion of shaft section 12 and extends outwardly and forwardly therefrom. A plurality of slits 24 are formed in shaft section 12 and extend from the rear portion to generally midway thereof. Such slits 24 are substantially aligned with the four sides of fin 17 so that same can be slidably and removably inserted into slits 24.

Figure 3:
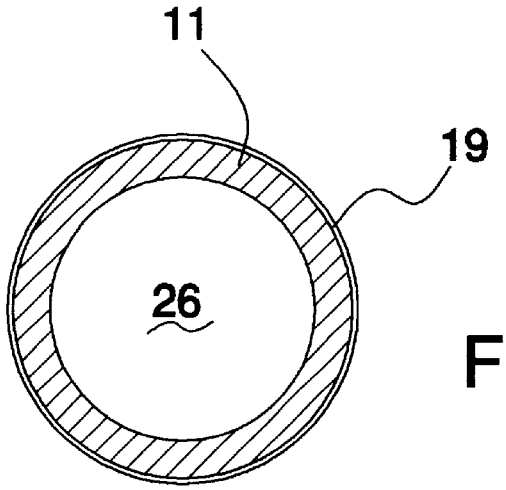
FIG. 3 is an enlarged cross-sectional view taken along line 3—3 in FIG. 1.

The convex rear end portion 14 of barrel section 11 is threaded at an interior surface thereof and defines a threaded female end portion for receiving the threaded male end portion 23 of shaft section 12. As can be seen from the illustration, the threaded end portion 14 has a substantially smooth outer surface, unlike barrel section 11. Such a barrel section has a hollow interior 26 so that the weight of the dart 10 can be maintained within a suitable range for its intended application, as best shown in FIG. 3. Similarly, the convex front end portion 15 of barrel section 11 includes an interior threaded surface for defining a threaded female end portion that can receive the male threaded end portion 20 extending rearwardly from the front shaft section 13.

Figure 4:
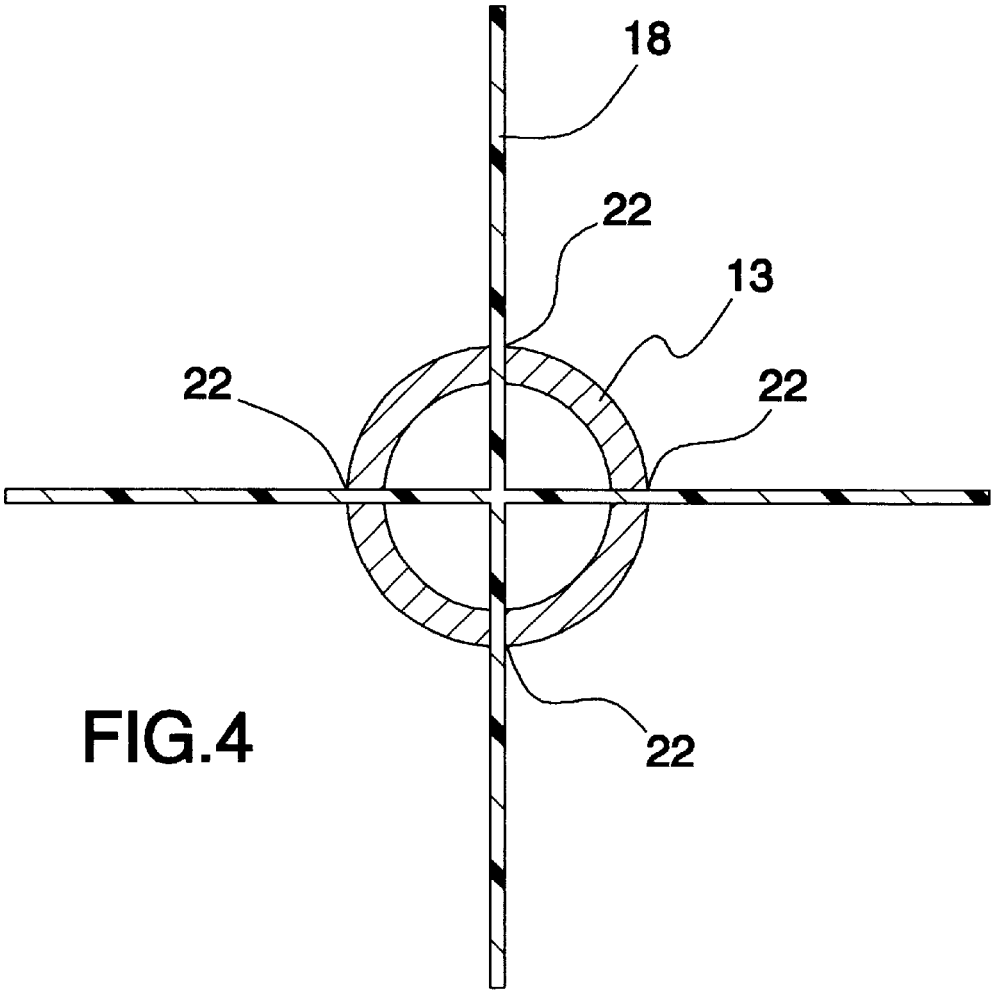
FIG. 4 is an enlarged cross-sectional view taken along line 4—4 in FIG. 1.

Such a shaft section 13 includes a front portion 21 which includes a plurality of substantially equally spaced grooves formed about an outer surface thereof and a threaded interior surface for defining a threaded female end portion. The shaft section 13 also includes a plurality of slits formed therein and extend from the threaded male end portion 20 to generally midway thereof. Such slits 22 are substantially aligned with the sides of the front fin 18. In particular, front fin 18 has four sides integral with each other, extending in substantially four different quadrants, and are substantially aligned with the plurality of slits 22 of shaft section 13 so that they may be slidably and removably inserted therein, as perhaps best shown in FIG. 4.

A tip section 16 includes a rear portion 25 which defines a threaded male end portion for engaging the threaded female end portion 21 of shaft section 13. The tip section 16 includes a generally conical or convex center portion having a greater diameter adjacent to the threaded male end portion 25 and a lesser diameter adjacent to its front portion 27. Such a front portion has a generally equal diameter throughout with a pointed tip for assisting the dart 10 to engage its intended target such as a dartboard, for example.

Figure 5:
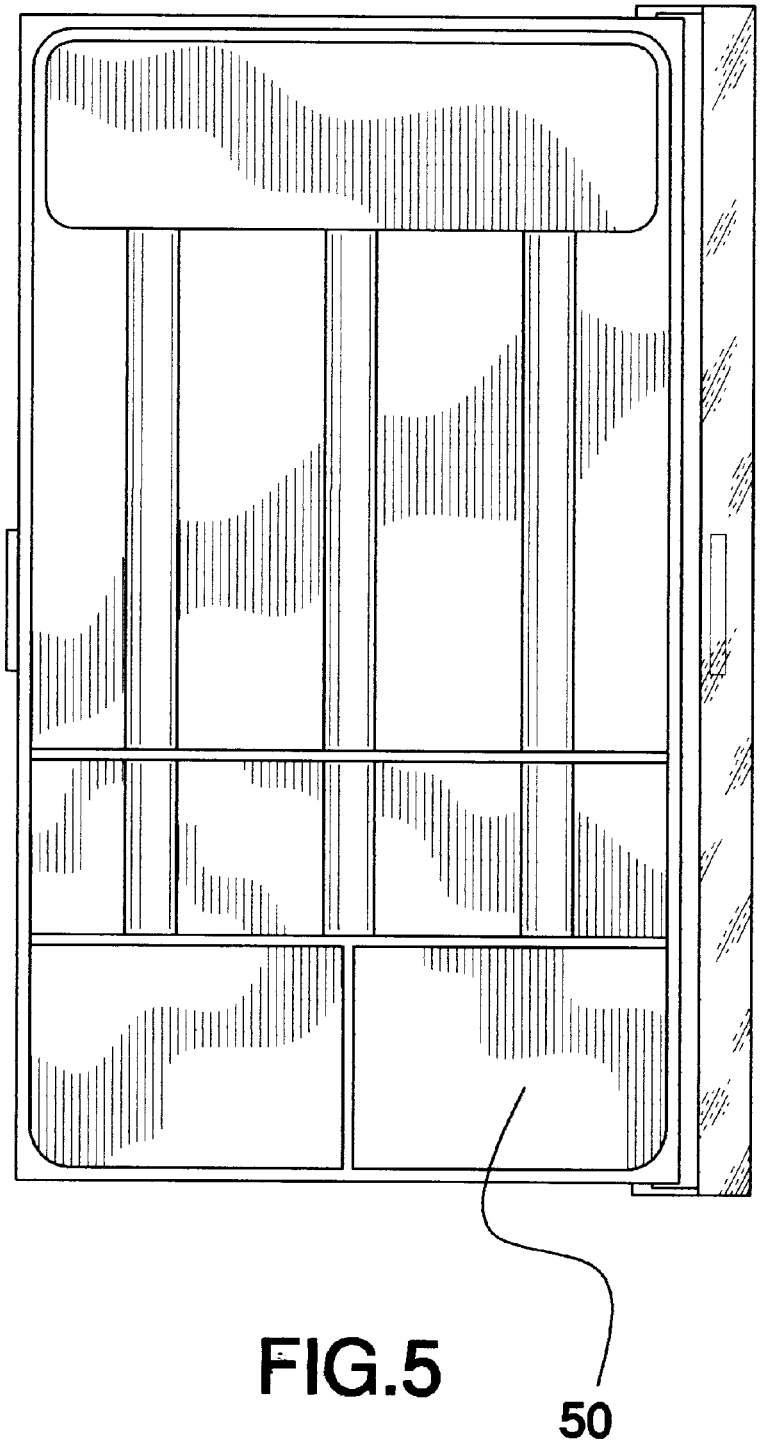
FIG. 5 is a top plan view showing a storage container, in accordance with the present invention.

Now referring to FIG. 5, the present invention further includes a storage container 50 having a plurality of spaced pockets for receiving one or more darts 10 therein. The storage container 50 has a substantially rectangular shape and includes an elongated carrying handle having opposed end portions pivotally connected thereto so that a user may conveniently transport the storage container 50 and darts 10, as needed.

Of course, it should be understood that dart 10 may be coated with various colors and designs for more accurately resembling different United States military missiles or bombs. Furthermore, fins 17 and 18 may include a variety of different shapes and may have less than or more than four sides, as depicted in this preferred embodiment. For example, the sides of fins 17 and 18 may not be disposed in substantially different quadrants or perpendicular to each other. Rather, such sides may be spaced in the same quadrants and at non-perpendicular angles, as would be readily appreciated to one skilled in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A dart comprising:

a hollow elongate barrel section having a longitudinal axis and including generally conical opposed end portions integral therewith and defining threaded female end portions respectively;

a plurality of elongate shaft sections each having a threaded male end portion removably connectable to the threaded female end portions respectively so that said barrel section becomes disposed between said plurality of shaft sections, one said plurality of shaft sections further having an opposed threaded female end portion, said plurality of shaft sections each further having a plurality of slits formed therein;

a plurality of fin sections removably engageable with said plurality of slits respectively and for assisting said dart to maintain a predetermined flight trajectory, said plurality of fins being disposed outwardly from the longitudinal axis of said barrel section; and a tip section having a threaded male end portion removably connectable to the threaded female end portion of said one shaft section.

2. The dart of claim 1, wherein said elongate barrel section has an outer surface having a plurality of substantially equally spaced grooves formed therein and between the end portions thereof.

3. The dart of claim 1, wherein the plurality of slits formed in said one shaft section extends from the threaded male end portion thereof to generally midway a length thereof.

4. The dart of claim 1, wherein another of said plurality of shaft sections has a non-threaded end portion with its plurality of slits extending therefrom to generally midway a length thereof.

5. The dart of claim 1, wherein one said plurality of fin sections has four sides integral with each other.

6. The dart of claim 1, wherein another said plurality of fin sections has five sides integral with each other.

7. The dart of claim 1, wherein said plurality of slits are substantially equally spaced apart about a perimeter of said plurality of shaft sections respectively.

8. A dart kit comprising:

a hollow elongate barrel section having a longitudinal axis and including generally conical opposed end portions integral therewith and defining threaded female end portions respectively;

a plurality of elongate shaft sections each having a threaded male end portion removably connectable to the threaded female end portions respectively so that said barrel section becomes disposed between said plurality of shaft sections, one said plurality of shaft sections further having an opposed threaded female end portion, said plurality of shaft sections each further having a plurality of slits formed therein and substantially equally spaced apart about a perimeter thereof respectively;

a plurality of fin sections removably engageable with said plurality of slits respectively and for assisting said dart to maintain a predetermined flight trajectory, said plurality of fins being disposed outwardly from the longitudinal axis of said barrel section; and a tip section having a threaded male end portion removably connectable to the threaded female end portion of said one shaft section.

9. The dart kit of claim 8, wherein said elongate barrel section has an outer surface having a plurality of substantially equally spaced grooves formed therein and between the end portions thereof.

10. The dart kit of claim 8, wherein the plurality of slits formed in said one shaft section extends from the threaded male end portion thereof to generally midway a length thereof.

11. The dart kit of claim 8, wherein another of said plurality of shaft sections has a non-threaded end portion with its plurality of slits extending therefrom to generally midway a length thereof.

12. The dart kit of claim 8, wherein one said plurality of fin sections has four sides integral with each other.

13. The dart kit of claim 8, wherein another said plurality of fin sections has five sides integral with each other.

14. A dart kit housed within a storage container and comprising:

a hollow elongate barrel section having a longitudinal axis and including generally conical opposed end portions integral therewith and defining threaded female end portions respectively, said barrel section has an outer surface having a plurality of substantially equally spaced grooves formed therein and between the end portions thereof;

a plurality of elongate shaft sections each having a threaded male end portion removably connectable to the threaded female end portions respectively so that said barrel section becomes disposed between said plurality of shaft sections, one said plurality of shaft sections further having an opposed threaded female end portion, said plurality of shaft sections each further having a plurality of slits formed therein;

a plurality of fin sections removably engageable with said plurality of slits respectively and for assisting said dart to maintain a predetermined flight trajectory, said plurality of fins being disposed outwardly from the longitudinal axis of said barrel section; and a tip section having a threaded male end portion removably connectable to the threaded female end portion of said one shaft section.

15. The dart kit of claim 14, wherein the plurality of slits formed in said one shaft section extends from the threaded male end portion thereof to generally midway a length thereof.

16. The dart kit of claim 14, wherein another of said plurality of shaft sections has a non-threaded end portion with its plurality of slits extending therefrom to generally midway a length thereof.

17. The dart kit of claim 14, wherein one said plurality of fin sections has four sides integral with each other.

18. The dart kit of claim 14, wherein another said plurality of fin sections has five sides integral with each other.

19. The dart kit of claim 14, wherein said plurality of slits are substantially equally spaced apart about a perimeter of said plurality of shaft sections respectively.

* * * * *